United States Patent [19]

Moncada

[11] Patent Number: 4,833,950

[45] Date of Patent: May 30, 1989

[54] VARIABLE ANGLE SCREWDRIVER

[76] Inventor: Jesus A. Moncada, 6304 Shirley Ave., El Paso, Tex. 79905

[21] Appl. No.: 235,680

[22] Filed: Aug. 24, 1988

[51] Int. Cl.[4] ..... B25B 13/00

[52] U.S. Cl. ..... 81/177.75; 403/57

[58] Field of Search ..... 81/177.75; 403/57 X, 403/74

[56] References Cited

U.S. PATENT DOCUMENTS 1,431,208 10/1922 Austin ..... 81/177.75

1,628,553 5/1927 Owens ..... 81/177.75

*Primary Examiner*—Frederick R. Schmidt

*Assistant Examiner*—Lawrence Cruz

*Attorney, Agent, or Firm*—Mack J. Casner

[57] ABSTRACT

Herein presented is a device for turning a screw with a handle at difficult angles to the screw. The device consist of a handle, a screwdriver head and a joint that joins the handle and screwdriver head. The joint consist of two spheres enclosed in a spherical housing.

The handle of the device can be turned and rotated while at an angle to the screwdriver head and screw. The screwdriver head remains in line with the screw and fitted in place in the grooves of the face of the screw.

1 Claim, 3 Drawing Sheets

VARIABLE ANGLE SCREWDRIVER

BACKGROUND OF THE INVENTION

The screw and screwdriver have been with us for ages. They remain essentially unchanged. Screws and screwdrivers come in a variety of sizes. Numerous handles for gripping have been used. There is a greater variety of handles than heads. Usually the handle and head of a screwdriver are directly connected and in fact they usually form one-single-continuous-straight piece. At times screws are located in areas difficult to reach with a standard screwdriver. Often even a screwdriver with a very small handle cannot be turned in small enclosed areas.

The unique device here is a tool to reach and efficiently turn screws in locations in which it is difficult to turn the handle of a standard screwdriver. The device's unique joint feature allows the handle to be placed at an angle to its head and this decreases the space needed immediately in front of the face of the screw.

SUMMARY OF THE INVENTION

The invention herein is a unique screwdriver tool. It consist of a handle, head and joint. The joint is a unique assembly that permits the handle to be rotated while at an angle to the head.

The hand grip part of the handle can be any size and shape. However, its size and shape will depend on usage. The end of the handle connected to the joint is in the shape of a lunette or doughnut. The head of the tool can also be any size and shape but it should be made to fit the screw to be turned. The head is securely attached to the joint.

The joint consist of two spheres enclosed in a large spherical housing. The spherical housing is large enough to contain the two smaller spheres and the lunette end of the handle. The lunette end is sandwiched between the two small spheres. The handle's lunette end is enclosed in the large sphere and its hard grip part sticks out from the large sphere through a large opening in the sphere.

BRIEF DESCRIPTION OF THE INVENTION

The invention can be better understood by examining the following in connection with accompanying drawings to wit:

PREFERRED EMBODIMENTS OF THE INVENTION

Figure 1:
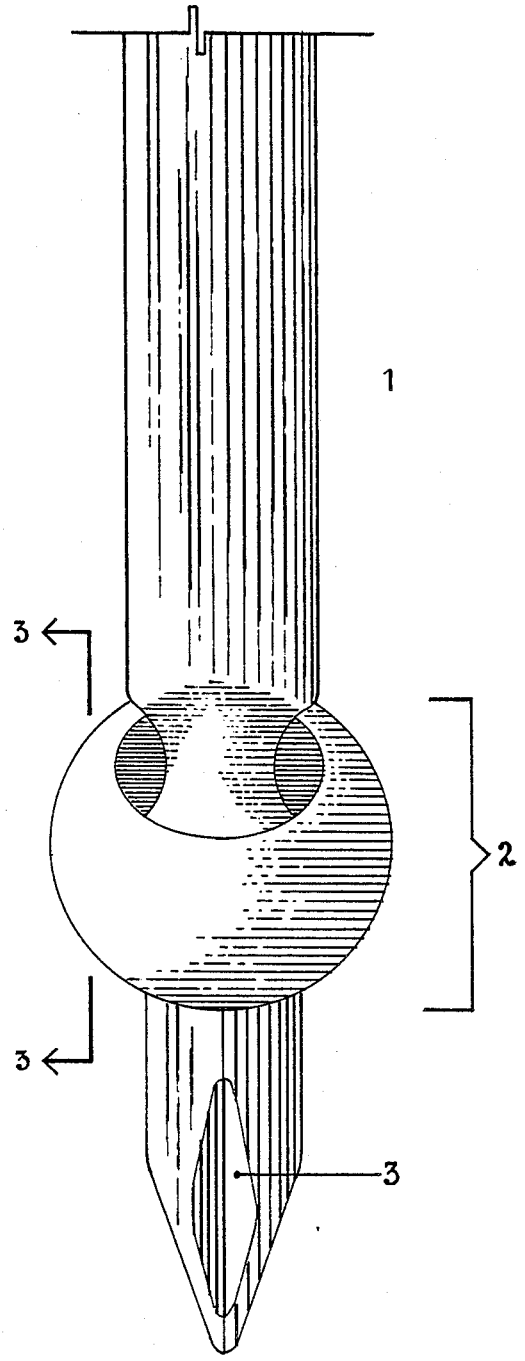
FIG. 1 is a plain view of the assembled features of the device.
Figure 2:
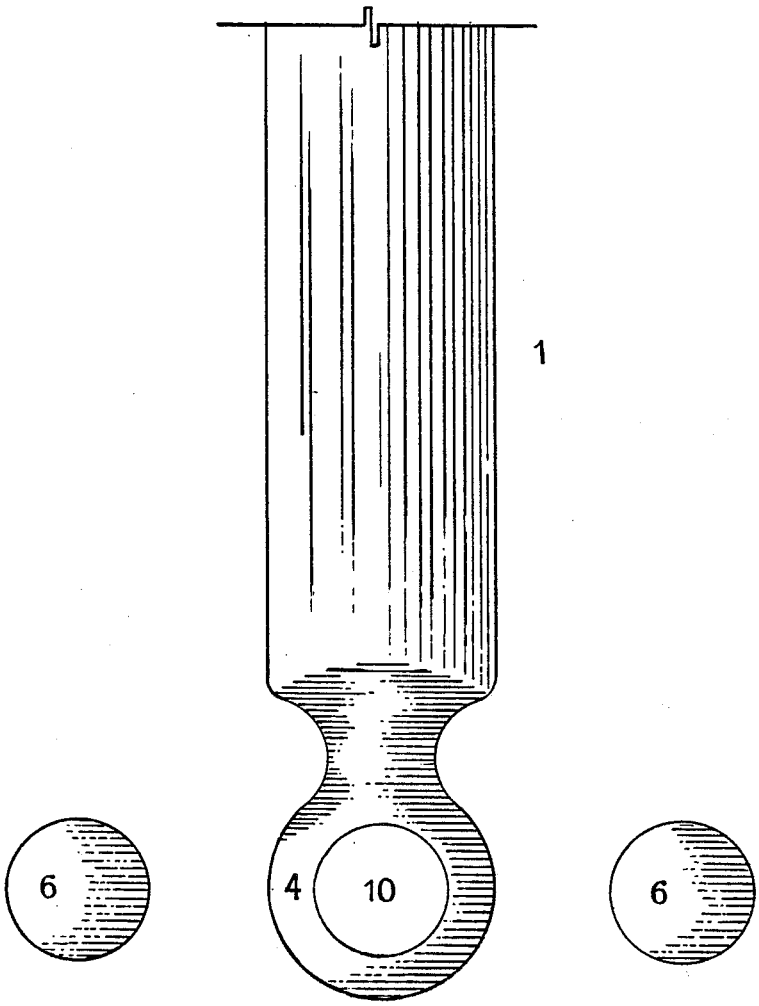
FIG. 2 is an enlarged view of the doughnut or lunette shaped end of the handle of the device.

Turning now to the drawings and the preferred embodiments of the invention, FIG. 1 shows the principal features of the device. The screwdriver tool consist of a handle (1), joint (2) and head (3). The part of the handle graspped by the hand can be any size and shape and its size and shape will depend on usage. FIG. 2 shows an end (4) of the handle which has a doughnut or lunette shape.

Figure 3:
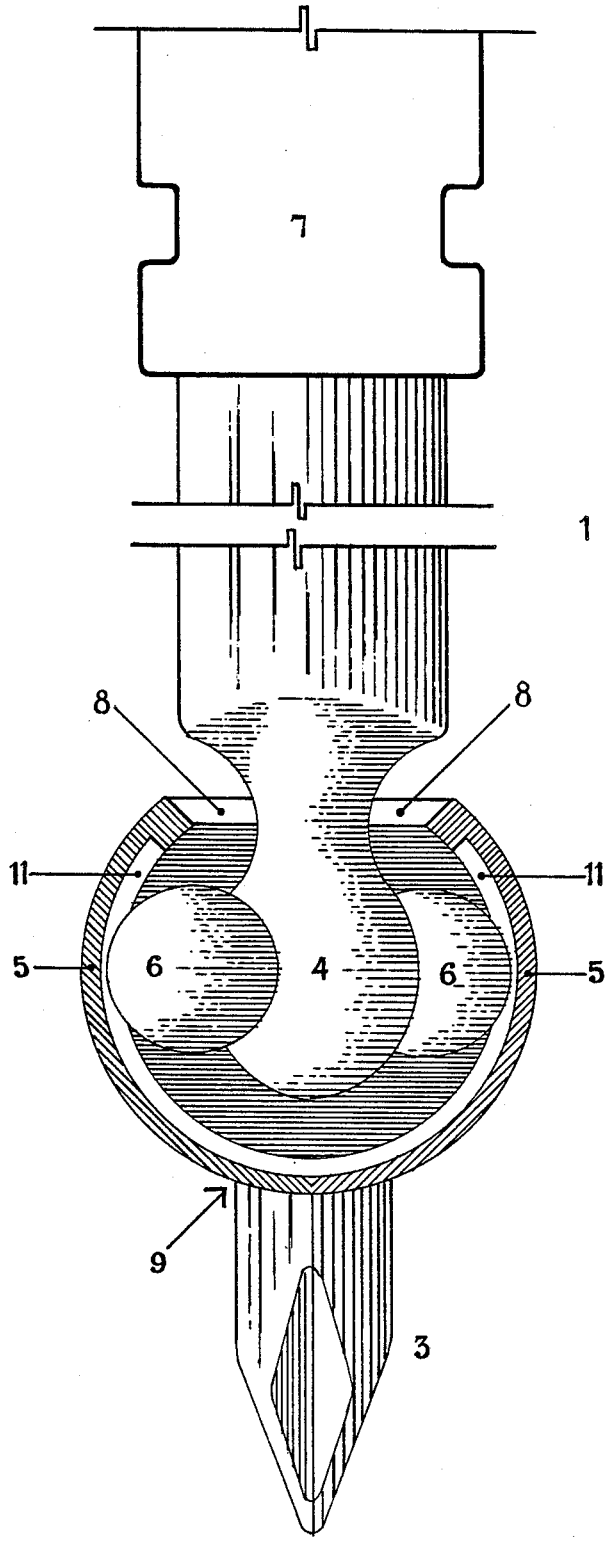
FIG. 3 is a cross-sectional view of the joint of the device.

FIG. 3 shows a cross-sectional view of the joint (2). It consist of a large sphere (5) housing and enclosing two smaller spheres (6). The large sphere (5) is large enough to contain the lunette or doughnut end (4) of the handle as well as the two smaller spheres (6). This end (4) of the handle is sandwiched between the two smaller spheres (6). The end (7) of the handle graspped by the hand extends out beyond the large sphere (5) through a large opening (8) in the large sphere.

The head (3) of the screwdriver device is securely attached to the joint (2) to a point (9) on the outer surface of the large sphere (5). The size and shape of the head (3) can be any size and shape depending on usage.

The size of the two smaller spheres (6) should be such that allows free movement in the larger sphere (5); such that they do not roll out into or through the large opening (8) and such that they roll along a groove (11) located on the inner surface of the large sphere (5). The groove (11) runs the circumference of the inner surface in the shape of a circle. The groove (11), however, stops immediately before the boundaries of the large opening (8). The size of the hole (10) in the lunette or doughnut end (4) of the handle should allow the two small spheres (6) to move freely but keep the handle (1) snuggly connected to the joint (2). The large opening (8) should be large enough and in such a shape as to give the attached handle optimum movement and positioning.

While the invention has been shown and described with reference to the preferred embodiments thereof, it will be understood by those skilled in the art that various changes in form and details may be made therein without departing from the spirit and scope of the invention.

What is claimed is:

1. A screwdriver tool comprising of the following: a handle, a joint and a head, one end of said handle is for grasping said screwdriver tool, the other end of said handle has a doughnut or lunette shape, said doughnut or lunette shaped end of said handle is sandwiched between two small spheres, said doughnut or lunette shaped end of said handle sandwiched between said two small spheres are placed in and enclosed in a large sphere, said arrangement of said doughnut or lunette shaped end of said handle sandwiched between said two small spheres being enclosed in a large sphere is said joint of said screwdriver tool, said head of said screwdriver tool is securely attached to the outer surface of said large sphere, said handle extends out of said large sphere through a opening in said large sphere, size of said two small spheres allows them to freely move in said large sphere such that they do not roll out through said opening in said large sphere and such that they roll along a groove located on the inner surface of said large sphere, said opening in said large sphere is of such size and shape as to give said handle optimum movement and positioning.

* * * * *